US006802508B2

(12) United States Patent
Moody

(10) Patent No.: US 6,802,508 B2
(45) Date of Patent: Oct. 12, 2004

(54) HARD WAY TRUE ODDS CRAPS

(76) Inventor: Ernest W. Moody, 2116 Redbird Dr., Las Vegas, NV (US) 89134

( * ) Notice: Subject to any disclaimer, the term of this patent is extended or adjusted under 35 U.S.C. 154(b) by 0 days.

(21) Appl. No.: 10/126,210

(22) Filed: Apr. 20, 2002

(65) Prior Publication Data

US 2003/0197329 A1 Oct. 23, 2003

(51) Int. Cl.[7] ..... A63F 3/00
(52) U.S. Cl. ..... 273/146; 273/139; 273/274
(58) Field of Search ..... 273/139, 146, 273/274, 415; 463/16–20, 21–22

(56) References Cited

U.S. PATENT DOCUMENTS

| | | | | | |
|---|---|---|---|---|---|
| 4,746,126 | A | * | 5/1988 | Angileri | 273/249 |
| 5,542,671 | A | * | 8/1996 | Stewart | 273/146 |
| 5,775,696 | A | * | 7/1998 | Sidlow et al. | 273/274 |
| 5,931,471 | A | | 8/1999 | Bonito | |
| 6,394,901 | B1 | * | 5/2002 | Marta | 463/20 |

OTHER PUBLICATIONS

Scarne's New Complete Guide to Gambling, pp. 259–336, copyright 1961, 1974.

Scarne on Dice, pp. 64,65,98,99 and 461, actual publication date not available but prior to Oct. 1996.

* cited by examiner

*Primary Examiner*—Vishu Mendiratta
(74) *Attorney, Agent, or Firm*—John Edward Roethel

(57) ABSTRACT

The game of craps is modified to allow a player to make an HARD WAY CRAPS bet instead of the standard ODDS bet. The HARD WAY CRAPS bet is available whenever a point number of 4, 6, 8, or 10 has been rolled and the player has a PASS line or COME line wager. If the point is 6 or 8, the HARD WAY CRAPS bet would pay two-to-one odds if the point is made with a 3,3 or 4,4 and would pay one-to-one odds if the point is made with any other roll. If the point is 4 or 10, the HARD WAY CRAPS bet would be pay four-to-one odds if the point is made with a 2,2 or 5,5 and would pay one-to-one odds if the point is made with any other roll. A corollary wager is offered for the DON'T PASS line or the DON'T COME line.

6 Claims, No Drawings

HARD WAY TRUE ODDS CRAPS

BACKGROUND OF THE INVENTION

This invention relates to a dice game, and more particularly to a variation of standard craps.

Craps is played using two standard six-sided dice. A player initially makes a PASS line wager on the first roll of the dice and winning PASS line wagers are paid even money (one-to-one odds on the amount of the wager). On the first roll, three possibilities are present—a roll of 7 or 11 is a winning roll, a roll of 2, 3 or 12 is a losing roll and a roll of any other number establishes a point to be made. If a point is made, the player continues to roll until either the point is rolled and the player wins his PASS line wager or a 7 is rolled and the player loses his PASS line wager.

In the casino version of craps, after a point is established, a player may make another wager such as taking odds on the point. When the player places an ODDS bet, the player is betting that the point number will be rolled before a 7 is rolled. In conventional craps, the ODDS bets do not pay even money. If the point is a 6 or an 8, the ODDS bets pay 6-to-5 odds based on the amount wagered on the ODDS bet. If the point is a 5 or a 9, the ODDS bets pay 3-to-2 odds based on the amount wagered on the ODDS bet. If the point is a 4 or a 10, the ODDS bets pay 2-to-1 odds based on the amount wagered on the ODDS bet.

The player may also make a COME bet which is treated like the initial roll to determine winning rolls, losing rolls or rolls that establish another point to be made. ODDS bets may also be made in relation to these COME bet wagers.

While the normal rolling of the dice is occurring, many other wagers can be made. Typical of these bets are "place bets" and the "hard ways bets." These bets stay in action until an event occurs or the player takes the bet down.

Other bets are only in action for one roll. Typical of these bets are "field bets." The determination of winning or losing on these bets is made on the next roll only. Traditionally, field bets include seven numbers out of the possible eleven numbers that can be rolled with a pair of dice. Field bets usually are bets that the numbers 2, 3, 4, 9, 10 11 and 12 will be rolled on that roll of the dice. It is customary in Nevada casinos that when a 12 is rolled, the payout is three-to-one odds; when a 2 is rolled, the payout is two-to-one odds; and all other winning field bet rolls pay one-to-one odds. Out of the 36 possible combinations (or "ways") that two dice that can be rolled, a field number can be rolled 16 ways. If a bettor wagers one unit over the entire 36 number cycle (36 total units wagered), the bettor will lose 20 times and the bettor will win 16 times. For a complete description of Craps, reference is made to *Scarne's New Complete Guide to Gambling*, pages 259–336, the disclosure of which is incorporated herein. See also, *Scarne on Dice*, pages 64–65 for a discussion on how to figure the odds at Craps, pages 98–99 for an explanation of field bets and page 461 for a definition of a field bet, all of which are incorporated herein by reference.

It is an object of the present invention to provide an improvement to the game of craps to make it more enjoyable to the player and to encourage additional wagering and play to the benefit of the gaming casino and its customers.

It is a feature of the present invention to modify the ODDS bet payout by providing for different payout odds depending on how the point is made. After a point is established and a player has made an ODDS bet on that point, the payout when the point is made is either one-to-one odds or higher odds depending on how the point is made.

It is an advantage of the present invention that craps players will be encouraged to make additional ODDS bets by the possibility of obtaining higher payouts than is conventional for the ODDS bets and that the enjoyment of craps will be increased by this additional wagering activity.

SUMMARY OF THE INVENTION

The game of craps is modified to allow a player to make a HARD WAY CRAPS bet instead of the standard ODDS bet. The HARD WAY CRAPS bet is available whenever a point number of 4, 6, 8, or 10 has been rolled and the player has a PASS line or COME line wager. If the point is 6 or 8, the HARD WAY CRAPS bet would pay two-to-one odds if the point is made with a 3,3 or 4,4 (matching pair of dice) and would pay one-to-one odds if the point is made with any other roll (non-matching pair of dice). If the point is 4 or 10, the HARD WAY CRAPS bet would be pay four-to-one odds if the point is made with a 2,2 or 5,5 (matching pair of dice) and would pay one-to-one odds if the point is made with any other roll (non-matching pair of dice). If the shooter craps out by rolling a Seven before the Point is rolled, the player loses his HARD WAYS CRAPS bet.

Additionally, a corollary wager is included with this HARD WAY CRAPS method of play and is offered to the bettors who play the DON'T PASS line or the DON'T COME line. Again, the bet is available whenever a point number of 4, 6, 8, or 10 has been rolled and the player has a DON'T PASS line or DON'T COME line wager. If the point is 6 or 8, the HARD WAY CRAPS bet would allow the bettor to lay two units and would pay one-to-two odds if the point is not made by the shooter crapping out (rolling a Seven). If the point is made with a 3,3 or 4,4 (matching pair of dice), then the bettor would lose his entire two unit wager. If the point is made with any other roll (non-matching pair of dice), the bettor would only lose one unit of his wager and would receive back the other one unit. If the point is 4 or 10, the HARD WAY CRAPS bet would allow the bettor to lay four units and would pay one-to-four odds if the point is not made by the shooter crapping out (rolling a Seven). If the point is made with a 2,2 or 5,5 (matching pair of dice), then the bettor would lose his entire four unit wager. If the point is made with any other roll (non-matching pair of dice), the bettor would only lose one unit of his wager and would receive back the other three units.

Alternatively, these HARD WAY CRAPS bets may be used along with the conventional ODDS bet so that the player would have the option of making either a conventional ODDS bet, a HARD WAY CRAPS bet or both in conjunction with the same point. The same option would apply to those bettors who play the DON'T PASS line or the DON'T COME line.

DETAILED DESCRIPTION OF THE PREFERRED EMBODIMENTS

In the conventional game of craps, the player may make a PASS line bet. If a point (either a 4, 5, 6, 8, 9 or 10) is rolled by the shooter, the player is then allowed to make a true ODDS bet behind his pass line bet. Many casinos offer double (or higher) odds which means that the ODDS bet may be up to double (or higher) the amount of the PASS line bet. If the shooter rolls the point number before a 7 is rolled, the player is paid 1 to 1 on his pass line bet and the true odds on his odds bet. For example, the player would be paid 2 to 1 odds on his ODDS bet if the point was a 4 or a 10, 3 to 2 odds for a point of 5 or 9, and 6 to 5 odds for a point of 6 or 8. In conventional craps, in addition to these PASS line and ODDS bets, the player is allowed to bet that certain numbers will be rolled the HARD WAY. The HARD WAY means the dice combinations of 2,2; 3,3; 4,4; and 5,5 for the numbers 4, 6, 8, and 10, respectively.

In the present modification, the conventional game of craps is modified to allow a player to make a "HARD WAY CRAPS" bet instead of the standard ODDS bet. The HARD WAY CRAPS bet is available whenever a point number has been rolled and the player has a PASS line or COME line wager. If the point is 6 or 8, the HARD WAY CRAPS bet would pay two-to-one odds if the point is made with a 3,3 or 4,4 and would pay one-to-one odds if the point is made with any other roll. If the point is 4 or 10, the HARD WAY CRAPS bet would pay four-to-one odds if the point is made with a 2,2 or 5,5 and would pay one-to-one odds if the point is made with any other roll.

For example, the player makes a $5 wager on the PASS line and the dice shooter rolls a point of 6. The player may now wager up to $5 as a HARD WAY CRAPS bet. If the point is rolled before a 7 is rolled, the player will win both his PASS line bet and his HARD WAY CRAPS bet. If the point is rolled with a dice combination of 3,3, the player would be paid $10 on his $5 HARD WAY CRAPS bet (plus the player gets his $5 wager returned to him). If the point is rolled with a dice combination of 5,1 or 4,2, the player would be paid $5 on his $5 HARD WAY CRAPS bet (plus the player gets his $5 HARD WAY CRAPS bet returned to him). In both instances, the player would be paid $5 on his PASS line wager (plus the player gets his $5 PASS line wager returned to him). If the dice shooter rolls a Seven before rolling the point, the player loses his HARD WAY CRAPS bet.

A corollary wager is offered to the bettors who play the DON'T PASS line or the DON'T COME line. Again, the bet is available whenever a point number of 4, 6, 8, or 10 has been rolled and the player has a DON'T PASS line or DON'T COME line wager. If the point is 6 or 8, the HARD WAY CRAPS bet would allow the bettor to lay two units and would pay one-to-two odds if the point is not made by the shooter crapping out (rolling a Seven). If the point is made with a 3,3 or 4,4 then the bettor would lose his entire two unit wager. If the point is made with any other roll, the bettor would only lose one unit of his wager and would receive back the other one unit. If the point is 4 or 10, the HARD WAY CRAPS bet would allow the bettor to lay four units and would pay one-to-four odds if the point is not made by the shooter crapping out. If the point is made with a 2,2 or a 5,5, then the bettor would lose his entire four unit wager. If the point is made with any other roll, the bettor would only lose one unit of his wager and would receive back the other three units.

For example, the player makes a $5 wager on the DON'T PASS line and the dice shooter rolls a point of 6. The player may now wager two units of his original wager ($10) as a HARD WAY CRAPS bet for the DON'T PASS. If a 7 is rolled before the point is rolled, the player will win both his DON'T PASS line bet and his HARD WAY CRAPS bet for the DON'T PASS. The player would be paid $5 on his $10 HARD WAY CRAPS bet (plus the player gets his $10 wager returned to him). The player would also be paid $5 on his DON'T PASS line wager (plus the player gets his $5 DON'T PASS line wager returned to him).

If the point is rolled before a 7 is rolled, the player will lose both his DON'T PASS line bet and all or part of his HARD WAY CRAPS bet for the DON'T PASS. If the point is rolled with a dice combination of 3,3, the player would be lose his entire $10 HARD WAY CRAPS bet. If the point is rolled with a dice combination of 5,1 or 4,2, the player would be lose only $5 of his $10 HARD WAY CRAPS bet (the player gets the other $5 HARD WAY CRAPS bet returned to him).

If the gaming establishment offers double (or higher) odds on the ODDS bet, the HARD WAY CRAPS bet of the present invention can also accommodate the same double (or higher) odds.

Alternatively, the HARD WAY CRAPS bet may be used along with the conventional ODDS bet so that the player would have the option of making either a conventional ODDS bet, a HARD WAY CRAPS bet or both in conjunction with the same point. Depending on the house rules of the gaming establishment, the HARD WAY CRAPS bet can be made in the same betting location as the conventional ODDS bet (which is made behind the line and adjacent to the PASS bet) if the HARD WAY CRAPS bet is made in place of the conventional ODDS bet. If the HARD WAY CRAPS bet is used along with the conventional ODDS bet, then the HARD WAY CRAPS bet location could be next to the conventional ODDS bet behind the line adjacent to the PASS bet or the HARD WAY CRAPS bet could be located in a separate designated area on the craps layout.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a dice game using a pair of conventional six-sided dice which are rolled by a shooter comprising:

g) a bettor making a PASS line wager;

h) the shooter making a roll of the dice to establish a Point of either 4, 6, 8 or 10;

i) after the Point of either 4, 6, 8 or 10 has been established, the bettor making a Hard Ways Craps wager;

j) the shooter rolling the dice and if the Point is made by a matching pair of dice, the Hard Ways Craps wager pays four to one odds if the Point is 4 or 10; or k) the shooter rolling the dice and if the Point is made by a matching pair of dice, the Hard Ways Craps wager pays two to one odds if the Point is 6 or 8; or l) the shooter rolling the dice and if the Point is made by a non-matching pair of dice, the Hard Ways Craps wager pays one to one odds; or m) the shooter rolling the dice and if a Seven is rolled, the bettor loses the Hard Ways Craps wager.

2. A method of playing a dice game using a pair of conventional six-sided dice which are rolled by a shooter comprising:

a) a bettor making a COME line wager;

b) the shooter making a roll of the dice to establish a Point of either 4, 6, 8 or 10;

c) after the Point of either 4, 6, 8 or 10 has been established, the bettor making a Hard Ways Craps wager;

d) the shooter rolling the dice and if the Point is made by a matching pair of dice, the Hard Ways Craps wager pays four to one odds if the Point is 4 or 10; or e) the shooter rolling the dice and if the Point is made by a matching pair of dice, the Hard Ways Craps wager pays two to one odds if the Point is 6 or 8; or f) the shooter rolling the dice and if the Point is made by a non-matching pair of dice, the Hard Ways Craps wager pays one to one odds; or g) the shooter rolling the dice and if a Seven is rolled, the bettor loses the Hard Ways Craps wager.

3. A method of playing a dice game using a pair of conventional six-sided dice which are rolled by a shooter comprising:

a) a bettor making a DON'T PASS line first wager;

b) the shooter making a roll of the dice to establish a Point of either 4 or 10;

c) after the Point of either 4 or 10 has been established, the bettor making a Hard Ways Craps second wager in increments of four units of the first wager;

d) the shooter rolling the dice and if the Point is made by a matching pair of dice, the bettor loses all of his second wager; or e) the shooter rolling the dice and if the Point is made by a non-matching pair of dice, the bettor loses only one unit of his second wager; or f) the shooter rolling the dice and if a Seven is rolled, the bettor wins one to four odds on the second wager.

4. A method of playing a dice game using a pair of conventional six-sided dice which are rolled by a shooter comprising:

a) a bettor making a DON'T COME line first wager;

b) the shooter making a roll of the dice to establish a Point of either 4 or 10;

c) after the Point of either 4 or 10 has been established, the bettor making a Hard Ways Craps second wager in increments of four units of the first wager;

d) the shooter rolling the dice and if the Point is made by a matching pair of dice, the bettor loses all of his second wager; or e) the shooter rolling the dice and if the Point is made by a non-matching pair of dice, the bettor loses only one unit of his second wager; or f) the shooter rolling the dice and if a Seven is rolled, the bettor wins one to four odds on the second wager.

5. A method of playing a dice game using a pair of conventional six-sided dice which are rolled by a shooter comprising:

a) a bettor making a DON'T COME line first wager;

b) the shooter making a roll of the dice to establish a Point of either 6 or 8;

c) after the Point of either 6 or 8 has been established, the bettor making a Hard Ways Craps second wager in increments of two units of the first wager;

d) the shooter rolling the dice and if the Point is made by a matching pair of dice, the bettor loses all of his second wager; or e) the shooter rolling the dice and if the Point is made by a non-matching pair of dice, the bettor loses only one unit of his second wager; or f) the shooter rolling the dice and if a Seven is rolled, the bettor wins one to two odds on the second wager.

6. A method of playing a dice game using a pair of conventional six-sided dice which are rolled by a shooter comprising:

a) a bettor making a DON'T PASS line first wager;

b) the shooter making a roll of the dice to establish a Point of either 6 or 8;

c) after the Point of either 6 or 8 has been established, the bettor making a Hard Ways Craps second wager in increments of two units of the first wager;

d) the shooter rolling the dice and if the Point is made by a matching pair of dice, the bettor loses all of his second wager; or e) the shooter rolling the dice and if the Point is made by a non-matching pair of dice, the bettor loses only one unit of his second wager; or f) the shooter rolling the dice and if a Seven is rolled, the bettor wins one to two odds on the second wager.

* * * * *